United States Patent [19]

Hodgson

[11] Patent Number: 4,728,030

[45] Date of Patent: Mar. 1, 1988

[54] RAILWAY SLEEPER WITH SPADE-LIKE END CONTOURS

[75] Inventor: William H. Hodgson, Keswick, Great Britain

[73] Assignee: British Steel Corporation, London, England

[21] Appl. No.: 941,832

[22] Filed: Dec. 15, 1986

Related U.S. Application Data

[63] Continuation of Ser. No. 735,486, May 20, 1985, abandoned.

[30] Foreign Application Priority Data

May 24, 1984 [GB] United Kingdom ..... 8413333

[51] Int. Cl.[4] ..... E01B 3/16

[52] U.S. Cl. ..... 238/61; 238/82

[58] Field of Search ..... 238/54, 56, 59, 60, 238/61, 82, 109, 110, 113, 63

[56] References Cited

U.S. PATENT DOCUMENTS

| | | | |
|---|---|---|---|
| 496,133 | 4/1893 | Ponsard | 238/61 |
| 522,974 | 7/1894 | Daniels | 238/82 |
| 714,820 | 12/1902 | Porter | 238/61 |
| 844,774 | 2/1907 | Bonzano | 238/61 |
| 859,809 | 7/1907 | Gardner | 238/82 |
| 1,586,052 | 5/1926 | Snyder | 238/61 |
| 1,658,051 | 2/1928 | Kens | 238/60 |
| 1,906,006 | 4/1933 | Harvey | 238/60 |
| 2,061,861 | 11/1936 | Wallmann et al. | 238/61 |

FOREIGN PATENT DOCUMENTS

| | | |
|---|---|---|
| 215157 | 5/1924 | United Kingdom . |
| 296394 | 8/1928 | United Kingdom . |
| 341965 | 1/1931 | United Kingdom . |
| 389704 | 3/1933 | United Kingdom . |
| 472618 | 12/1935 | United Kingdom . |
| 2110277 | 6/1983 | United Kingdom . |

*Primary Examiner*—Robert B. Reeves
*Assistant Examiner*—Scott H. Werny
*Attorney, Agent, or Firm*—Bacon & Thomas

[57] ABSTRACT

According to the invention there is provided a railway sleeper having a formed inverted channel-shaped section the ends of which have their upper surfaces downwardly inclined and shaped in a corrugated fashion to add strength and rigidity to said ends.

The 'dished spade' end contour of the sleeper may be pressed from a standard rolled steel channel section. By virtue of the stronger ends thus produced these portions can sustain a greater load than the conventional design hitherto—this means that the length of the sleeper according to this invention may be much shorter, e.g. 20% less than the conventional design for the same load bearing capacity, representing a considerable cost savings. The shape facilitates stacking, and lateral insertion beneath the track for track maintenance and replacement etc.

9 Claims, 4 Drawing Figures

RAILWAY SLEEPER WITH SPADE-LIKE END CONTOURS

This application is a continuation of application Ser. No. 735,486, filed May 20, 1985, now abandoned.

This invention relates to railway sleepers, and more particularly relates to channel-section metal sleepers having downwardly inclined 'spade' ends.

Conventional spade end sleepers which have their plain upper surfaces downwardly inclined at an angle of between say 40° and up to 90° to the horizontal, suffer from the drawback that loads cannot readily be sustained closely adjacent these ends, because they 'dig in' to the ballast in response to sideways movement, they cannot be readily replaced for maintenance purposes, etc., and with steep angled ends they do not readily stack.

It is an object of this invention to provide an improved sleeper which mitigates the above problems.

According to the invention there is provided a railway sleeper having a formed inverted channel-shaped section the ends of which have their upper surfaces downwardly inclined and shaped in a corrugated fashion to add strength and rigidity to said ends.

According to the invention there is further provided a railway sleeper having a formed inverted channel-shaped section the ends of which have their upper surfaces downwardly inclined and so shaped to progressively define at their extremities, in end elevation, a serpentine path having downwardly inclined portions at the side and two further such portions inwardly thereof.

The 'dished spade' end contour of the sleeper may be pressed from a standard rolled steel channel section. By virtue of the stronger ends thus produced these portions can sustain a greater load than the conventional design hitherto—this means that the length of the sleeper according to this invention may be much shorter, e.g. 20% less than the conventional design for the same load bearing capacity, representing a considerable cost savings. The shape facilitates stacking, and lateral insertion beneath the track for track maintenance and replacement, etc., and although the end design is such that it affords less restraint against lateral load thrusts it is still 50% or so greater than the standard concrete or wooden sleeper.

In order that the invention may be fully understood one embodiment thereof will now be described with reference to the accompanying drawings in which FIG. 1 is a longitudinal section on the centre line of a sleeper according to the invention;

Figure 1:
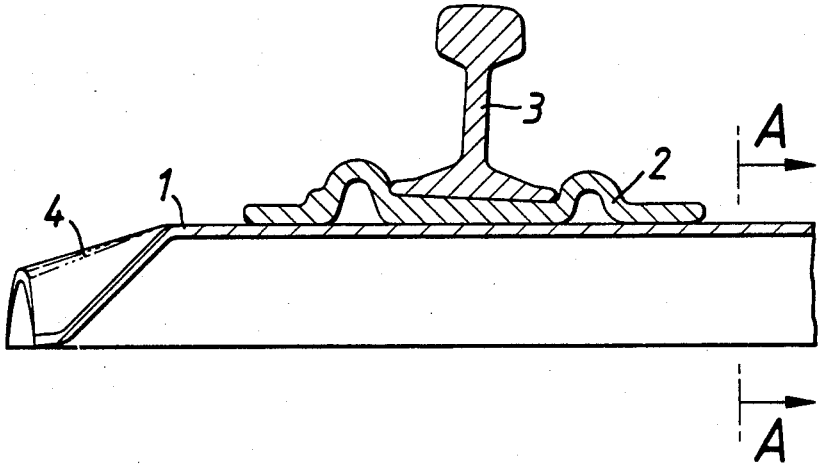
Figure 2:
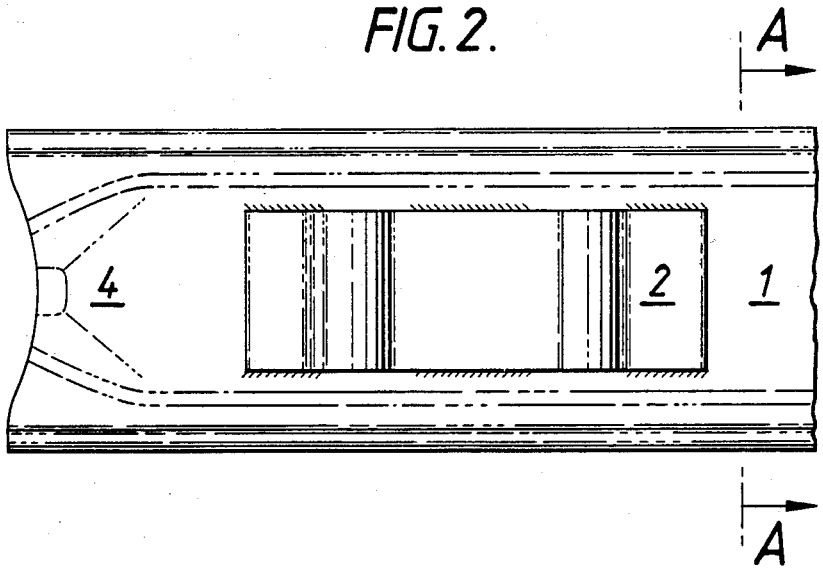
FIG. 2 is a plan view of the sleeper of FIG. 1 (without the rail)

Referring now to FIG. 1 and 2 in the drawings a steel sleeper 1 has welded to it a rolled steel base plate 2 which in the example shown has an inwardly sloping upper surface such as to support a rail 3 in a tilted fashion. The body of the sleeper is roll-formed and then the end is press-formed in a manner such that the upper surface 4 is inclined downwardly and so shaped as to progressively define at its extremity a serpentine or sinuous configuration, the sleeper being of a consistent width and continuous form along its entire length.

Figure 4:
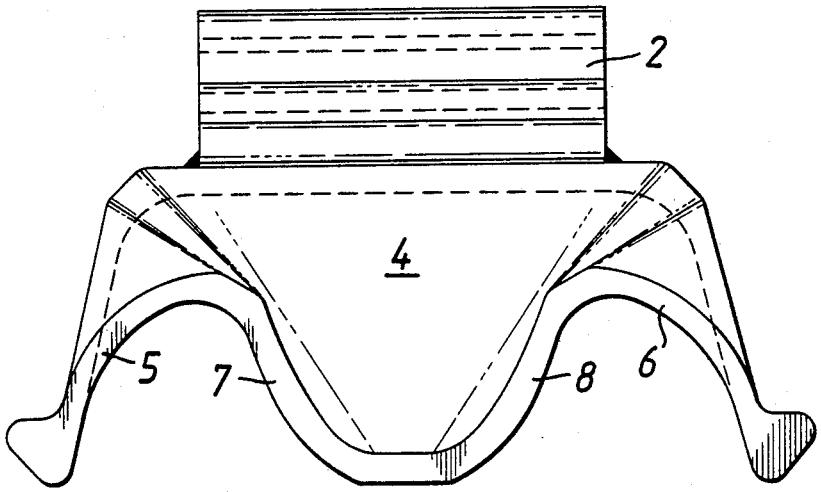
FIG. 4 is an end elevation of FIG. 2.

This is better illustrated in FIG. 4 where it can be seen that it approximates to an undulating path extending over 1½ cycles. The sides each have upwardly inclined surfaces 5, 6 merging into a U-shaped central section having downwardly inclined surfaces 7, 8.

Four 'upright' portions are thus manifested by this form of construction, significantly strengthening the sleeper ends giving rise to the advantages claimed above.

Figure 3:
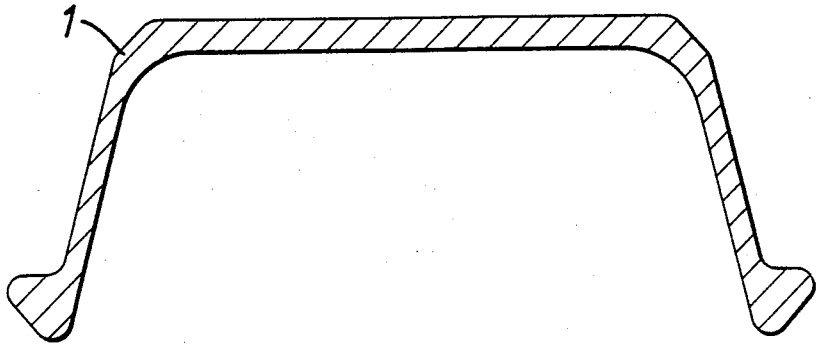
FIG. 3 is a section on A—A in the above Figures.

To give a practical example on the above, with a 1435 mm track gauge, the overall sleeper length may be 2,300 mm, the as-rolled section (FIG. 3) with side wall thickness of 6.75 mm may have a weight of 27 kg/meter with the total weight of the sleeper as pressed in the normal industrial sleeper grade steel being 62 kg.

Although the invention has been described with reference to the particular embodiment illustrated, it is to be understood that various modifications may readily be made without departing from the scope of this invention. For example, the precise shape and size of the strengthened 'corrugated' ends may differ from that shown compatible with the objects as recited above.

I claim:

1. A railway sleeper having an inverted rolled steel channel-shaped section the ends of which have their upper surfaces downwardly inclined and inwardly tapered over their central region towards the sleeper extremities whereby to define at said extremities a corrugated contour to add strength and rigidity to the sleeper, said ends being press formed, the sleeper being of consistent width and continuous form along its entire length.

2. A railway sleeper having a formed inverted rolled steel channel-shaped section the ends of which have their upper surfaces downwardly inclined and inwardly tapered over their central region towards the sleeper extremities so as to progressively define at said extremities, in end elevation, a serpentine path having downwardly inclined portions at the side and two further such portions inwardly thereof, said ends being press formed, the sleeper being of consistent width and continuous form along its entire length.

3. A sleeper according to claim 2, wherein the width across the bottom of the inverted section is consistent along its whole length including the bottom of the said downwardly inclined side portions at the ends, the underside of the inverted section being flat over its whole length.

4. A sleeper according to claim 3, wherein the serpentine shape of each said end is symmetrical, a U-shaped depression lying centrally thereof.

5. A sleeper according to claim 4, wherein the section is roll-formed steel, the ends being press-formed.

6. A sleeper according to claim 5, designed so as to be stackable with other identical sleepers, one nesting within the other.

7. A roll formed steel railway sleeper having an inverted channel-shaped section and press formed ends having their upper surfaces downwardly inclined and inwardly tapered over their central region towards the sleeper extremities so as to progressively define at said extremities, in end elevation, a serpentine path having downwardly inclined portions at the side and two further such portions inwardly thereof defining a U-shaped central depression, and each sleeper being of consistent width and continuous form along its entire length.

8. A sleeper according to claim 7, wherein the width across the bottom of the inverted section is consistent along its whole length including the bottom of said downwardly inclined side portions at the ends, the underside of the inverted section being flat over its whole length.

9. A sleeper according to claim 8, comprising two rail base plates secured to its upper surface.

* * * * *